United States Patent [19]

Garner

[11] Patent Number: 4,828,179

[45] Date of Patent: May 9, 1989

[54] ROTATING SPRAY APPARATUS

[76] Inventor: Jim W. Garner, 916 E. 1st St., Emmett, Id. 83617

[21] Appl. No.: 201,764

[22] Filed: Jun. 3, 1988

[51] Int. Cl.[4] ..... B05B 3/04; F01B 3/02

[52] U.S. Cl. ..... 239/240; 91/503

[58] Field of Search ..... 239/93, 99, 101, 237, 239/240, 263; 91/503, 180

[56] References Cited

U.S. PATENT DOCUMENTS

| | | | |
|---|---|---|---|
| 1,097,410 | 5/1914 | Flack et al. | 239/240 |
| 1,719,757 | 7/1929 | Can Reede | 91/503 |
| 3,185,557 | 5/1965 | Gerber | 91/503 |
| 3,253,410 | 5/1966 | Albers | 91/503 |
| 4,298,015 | 11/1981 | Garza | 239/240 |

FOREIGN PATENT DOCUMENTS

| | | | |
|---|---|---|---|
| 669878 | 4/1952 | United Kingdom | 91/503 |

*Primary Examiner*—Andres Kashnikow
*Assistant Examiner*—Karen B. Merritt
*Attorney, Agent, or Firm*—Frank J. Dykas; Craig M. Korfanta

[57] ABSTRACT

A rotating spray nozzle assembly 10, for use with high pressure water, has a hollow distribution arm 12 radially attached to a hollow rotation shaft 14. Attached to distribution arm 12 are a plurality of spray nozzles 13. Pressurized water from water chamber 16 sequentially activates, via inlet rotor 21, bevelled and pistons 24 which in turn drive cylindrical wedge cam 31. Cylindrical wedge cam 31 circumscribes and is attached to hollow rotating shaft 14. The hollow rotating shaft 14 derives its rotation from the action of bevelled end pistons 24.

5 Claims, 6 Drawing Sheets

ROTATING SPRAY APPARATUS

BACKGROUND OF THE INVENTION

1. Technical Field

This invention relates to spray devices in general and in particular to a rotating spray nozzle assembly for high pressure water applications such as automatic car washes and the like.

2. Background Art

Typical applications for spray nozzle assemblies include shower heads, lawn sprinklers, paint applicators, and car washes. The main objective of most spray assemblies is to disburse pressurized water over a large surface area. Paint applicators and lawn sprinklers are additionally concerned with the spray pattern, as it is necessary to disperse the pressurized water in a uniform manner. Shower heads, on the other hand, are more concerned with the washing action of the water upon impact with a surface. The spray nozzles for automatic car washes have unique design concerns in that they must deliver a uniform concentration of water over a large area while still providing an effective washing action to the water.

Common rotating lawn sprinklers use directional nozzles to impart a rotational force on their rotating distribution members. The purpose for the rotation is to increase the effective area over which a uniform concentration of water is applied. This directional nozzle apparatus is extremely effective for use with the relatively low water pressures associated with common water lines. The directional nozzle apparatus is however, not well suited for high pressure applications, simply because the angular velocity, or rpm, of the distribution member is directly related to the water pressure. If a directional type nozzle were used in an automatic car wash, which has a water pressure of approxiamtely 1,220 psi, it would result in an extremely high angular velocity and probable disintegration of the nozzle apparatus due to centrifugal effects. Additionally, the tangential orientation of the directional nozzles results in the water droplets having substantial tangential velocities and consequently deliver an unacceptable washing action.

There have been several pertinent developments in the design of shower heads, which are concerned with providing a pulsating spray pattern for therapeutic use. A desirable byproduct of the massaging spray is an increased scrubbing effect of the water upon impingement with a surface. This increased washing action is attributable to the fact that the water impinges the washing surface from a direction which is perpendicular, or normal to the surface. Typical of the pulsating spray head art are the teachings of Bruno, U.S. Pat. Nos. 3,734,410 and 4,018,385, both of which teach similar pulsating spray heads. The spray heads, as taught by Bruno, both use a wobble plate located just prior to the water exit holes. The wobble plate is hydraulically activated to oscillate back and forth. The back and forth motion of the wobble plate produces a therapeutic, pulsating effect. These type of spray heads are unsuitable for high pressure applications such as in a car wash, because of uncontrollable vibrations resulting from the pulsating apparatus. They also produce a very limited sized spray pattern.

What is needed is a high pressure spray nozzle assembly capable of dispersing water over a large surface area which is free from pulsation and delivers spray with a suitable washing action.

Accordingly, it is an object of this invention to provide a rotating spray nozzle assembly for use in automatic car washes which produces a uniform scrubbing spray pattern from a high pressure water source.

Some additional objects of this invention are to provide a rotating spray nozzle assembly wherein the angular velocity of the distribution member can be selected independent of the high pressure water source, and further, to produce a rotating spray nozzle assembly which does not impart a substantial tangential velocity to the spray droplets.

DISCLOSURE OF INVENTION

These objects are accomplished by a rotating spray nozzle assembly which is attachable to a high pressure water source supply. The rotating spray nozzle assembly utilizes a hollow shaft which has a hollow distribution arm attached perpendicularly thereto. A plurality of bevelled end pistons drive a cylindrical wedge cam attached to the hollow shaft, thereby imparting a rotation to the hollow shaft and distribution arm. The bevelled end pistons are sequentially activated by an inlet rotor which controls the pressurized water. The pistons in turn provide a downward force on the incline of the cylindrical wedge cam. This downward force causes radial motion of the cylindrical wedge cam, hollow shaft and attached distribution arm. The bevelled end pistons further provide a virtually continuous source of pressurized water to the interior of the hollow shaft through a plurality of inlet holes located in the upstream portion of the shaft. The water is dispersed by a plurality of nozzles attached to the distribution arm.

The angular velocity of the hollow shaft and attached distribution arm is a function of both the water pressure and the incline angle of the cylindrical wedge cam. Therefore, by knowing the water pressure, the installer can alter the cam angle and consequently the piston length, to provide a particular desired rotational velocity. A particular application in which it is desirable to have rotating nozzle assemblies which rotate at different angular velocities, is an automatic car wash. For instance, it is desireable to have a high rpm for the rotating nozzle assembly which washes the front bumper of an automobile, to remove particularly difficult stains such as dried insects and the like. On the other hand much lower rotational velocities are desireable for the spray nozzles which wash the sides of the automobile.

BEST MODE FOR CARRYING OUT INVENTION

Figure 1:
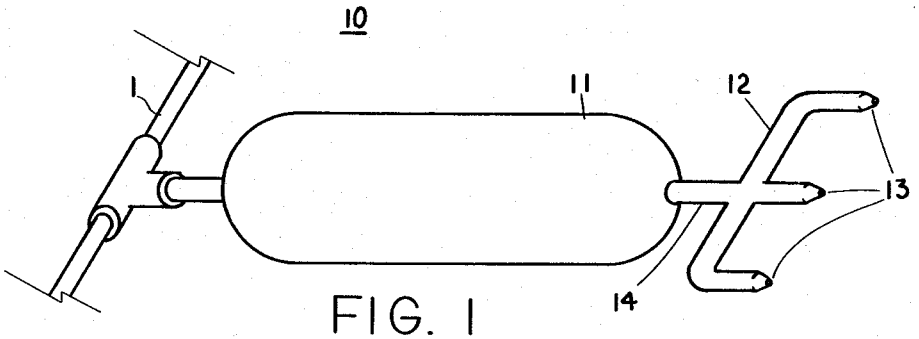
FIG. 1 is a perspective representational view of my new rotating spray nozzle assembly.

My new rotating spray nozzle assembly 10, is shown in FIG. 1 attached to a high pressure supply line 1. Rotating spray nozzle assembly 10 has an elongated cylindrical housing 11 centered about a longitudinal axis. A rotating hollow shaft 14 is coincident on the longitudinal axis and has a laterally disposed hollow distribution arm 12 radially attached thereto. A plurality of spray nozzles 13 are attached to hollow distribution arm 12.

Figure 2:
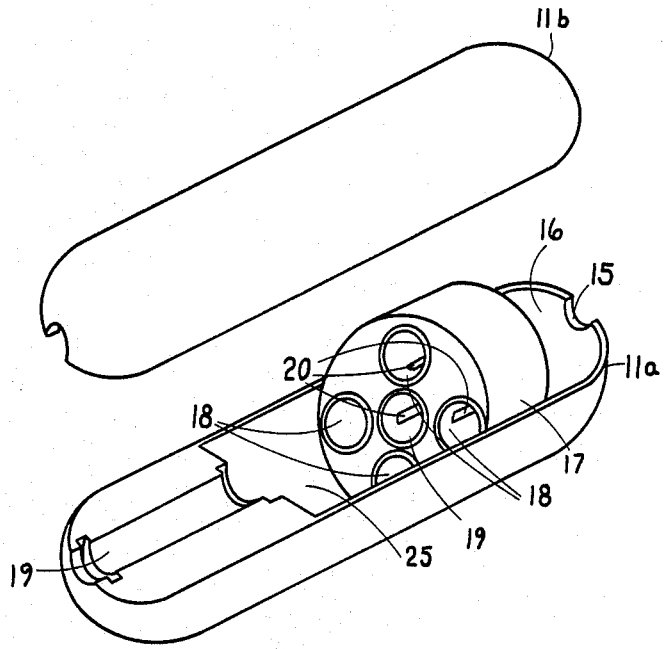
FIG. 2 is an exploded perspective representational view of the two part housing.

Referring now to FIG. 2, housing 11 is shown as a two-part assembly constructed from parts 11a and 11b. Housing part 11a has inlet 15, or portion thereof, disposed in one end. Inlet 15 allows for the introduction of pressurized water into water chamber 16. Piston carriage 17, having a plurality of piston cylinders 18 uniformly angularly oriented around and parallel to the longitudinal axis, is attached to housing part 11a and separates the water chamber 16 from oil chamber 25. Disposed along the longitudinal axis is shaft cylinder 19 for rotatably receiving the hollow rotating shaft 14, shown in FIGS. 1, 3 and 4. Within the part of the shaft cylinder 19, which is located in piston carriage 17, are cylinder outlet passages 20. Cylinder outlet passages 20 allow the pressurized water to flow from the individual piston cylinders 18 into the interior of hollow rotating shaft 14.

Figure 3:
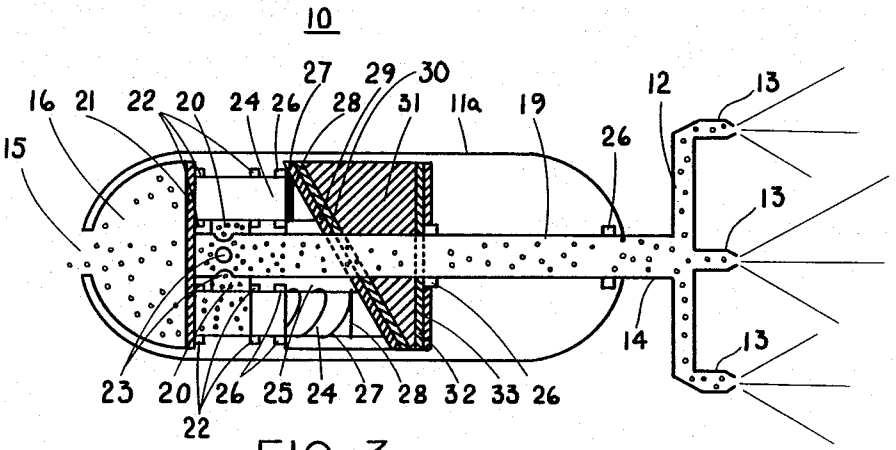
FIG. 3 is a side sectional view of my rotating spray nozzle assembly.

Referring now to FIG. 3, hollow rotating shaft 14 is shown positioned in shaft cylinder 19. Inlet rotor 21 is perpendicularly attached to one end of hollow rotating shaft 14. Hollow rotating shaft 14 is held in shaft cylinder 19 by a plurality of combination water seal-bearings 22 and combination oil seal-bearings 26. Downstream of the inlet rotor are shaft inlet holes 23 which serve to pass pressurized water to the hollow rotating shaft 14 from piston cylinders 18.

A plurality of bevelled end pistons 24 are disposed within piston cylinders 18 and slidably held in place by water seal-bearings 22 and oil seal-bearings 26. A cylindrical wedge cam 31, which is attached to and circumscribes hollow rotating shaft 14, is disposed within oil chamber 25. Thrust bearing 30 rests against the inclined surface of cylindrical wedge cam 31. Thrust plate 29 serves as a wear surface for engagement with the bevelled end of bevelled end pistons 24, when forced downward by the incoming pressurized water. Cylindrical wedge cam 31 rides on a cam washer 32 and cam bearing 33.

Figure 4:
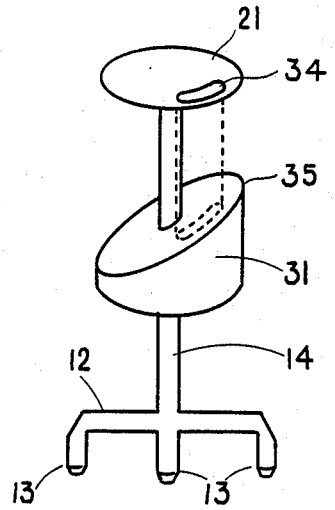
FIG. 4 is a perspective representational view of the inlet rotor, cylindrical wedge cam, hollow shaft, and distribution arm assembly.

Referring now to FIG. 4, the relative positioning of inlet opening 34 with respect the apogee point 35 of cylindrical wedge cam 31, is illustrated by the dotted line projection of the inlet opening 34 onto the inclined surface of cylindrical wedge cam 31. Inlet opening 34 is located radially clockwise of apogee 35. This particular arrangement will produce a counterclockwise rotation of the assembly of FIG. 4, wherein inlet opening 34 lags apogee 35. Bevelled end pistons 24 as shown in FIG. 5, are forced downward when the inlet opening 34 exposes the upper surface of the piston head to the high pressure water.

Figure 5:
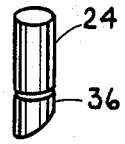
FIG. 5 is a perspective representational view of a bevelled end piston.
Figure 6:
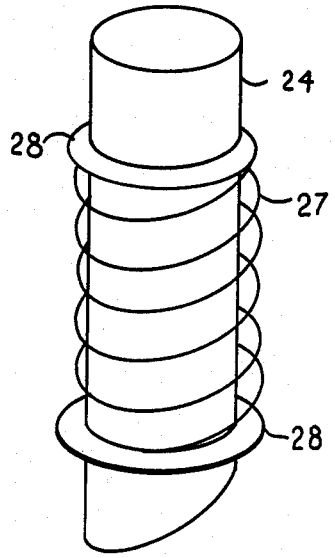
FIG. 6 is a perspective representational view of a bevelled end piston, spring and retainer.

Referring to FIGS. 5 and 6, a bevelled end piston 24 is depicted as being generally cylindrical in nature and has a flat piston head end and a flat bevelled end. It should however be noted that a spherical end would perform equally well. The bevelled end pistons 24 have a spring retaining grove 36 circumscribing their outer surfaces. Piston spring retainer 28 is disposed within spring retaining groove 36 and serves as a means for retaining piston spring 27 on bevelled end piston 24. In practice, the piston head end of spring 27 butts up against the oil chamber surface of the piston carriage.

Figure 7:
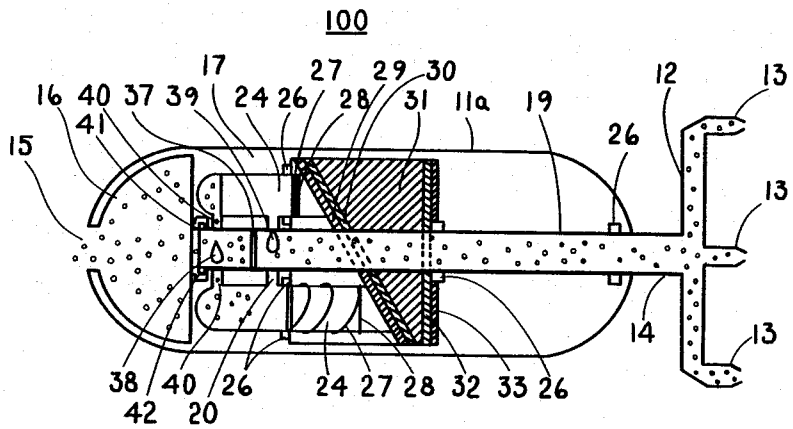
FIG. 7 is a side sectional view of a second embodiment of my rotating nozzle assembly.

Referring to FIG. 7, a second embodiment of my new rotating nozzle assembly 100 is shown and uses a shaft partition 37 located in the upstream end of hollow rotating shaft 14 and divides the shaft into two portions. The upstream end is exposed to water chamber 16 and has distribution port 38 located in the shaft wall. Distribution port 38 has the shape of a teardrop in this particular embodiment. Pressurized water enters the hollow rotating shaft 14 from water chamber 16 and is distributed to piston cylinders 18 at the piston head end by distribution passages 40. The hollow rotating shaft 14 is held in position by flange 41 engaged with retaining bearing 42, which is attached to the top of cylinder carriage 17.

Pressurized water then enters the downstream portion of hollow rotating shaft 14 by passing through cylinder outlet passage 20 and into collection port 39. The distribution port 38 can be disposed about the longitudinal axis so that it is radially advanced with respect to the collection port 39. This particular configuration of distribution port 38 and collection port 39 provides a time lag between the inlet and outlet of the pressurized water to and from the piston cylinder 18 and serves the same purpose as the relative positioning of the inlet rotor with respect to opogee of the cam, as illustrated in the first embodiment.

In use, pressurized water enters the rotating nozzle assembly through the main inlet and is stored under pressure in the water chamber. The pressurized water is then sequentially introduced into each successive piston cylinder and exerts downward pressure on bevelled end pistons. As the piston progresses downwardly, the shaft inlets are exposed and the water pressure is transferred to the interior of the hollow shaft and flows through the rotating distribution arm and out the attached spray nozzles.

The distinguishing features of my rotating spray nozzle assembly are, the ability to disperse water which impinges normally to the washing surface and that the rotational velocity of the rotating nozzle can be controlled independent of the water pressure by simply adjusting the cam angle and/or the cross-sectional area of the inlet and outlet ports. This last feature is especially important because it allows the water to pass through the rotating nozzle assembly without a substantial reduction in water pressure of the water dispersed to the washing surface.

While there is shown and described the present preferred embodiment of the invention, it is to be distinctly understood that this invention is not limited thereto but may be variously embodied to practice within the scope of the following claims.

I claim:

1. A rotating spray nozzle assembly for washing planar surfaces using pressurized water comprising:

a longitudinally disposed rotatable hollow shaft having an inlet for introducing pressurized water to the interior of said shaft;

a piston carriage having a central receiving shaft cylinder coincident to the longitudinal axis, rotatably engaged with said hollow shaft, said piston carriage further having a plurality of piston cylinders uniformly angularly oriented around, and parallel to, the longitudinal axis, for slidably holding a plurality of bevelled end pistons;

a cylindrical wedge cam attached to and circumscribing said rotatable hollow shaft;

a plurality of pistons having a piston head and a bevelled end slidably mounted within said piston cylinders and in slidable frictional engagement at the bevelled end with the surface of the cylindrical wedge cam;

a hollow distribution arm radially attached to a first end of said rotatable shaft for distributing water therefrom, whereby said hollow distribution arm rotates in a laterally disposed plane;

a plurality of spray nozzles operably attached to said distribution arm for dispersing water therefrom, in a direction normal to said laterally disposed plane; and an inlet rotor having a circular disc having a hole radially disposed within the disc's surface and further positioned about the shaft so said hole is coincident on a point on said cylindrical wedge cam which lies either clockwise or counterclockwise of the apogee of said cylindrical wedge cam.

2. A rotating spray nozzle assembly comprising:

a longitudinally disposed rotatable hollow shaft having inlet holes for introducing pressurized water to the interior of said shaft;

a cylindrical wedge cam attached to and circumscribing said rotatable hollow shaft;

a plurality of bevelled end pistons operably attached to said cam and further being reciprocally activated by said pressurized water source;

a hollow distribution arm radially attached to a first end of said rotatable shaft for distributing water therefrom;

a plurality of spray nozzles operably attached to said distribution arm for disbursing water therefrom;

an inlet rotor attached to a second end of said rotatable shaft for sequentially activating said bevelled end pistons, said inlet rotor further having a hole radially disposed within its surface and further positioned about the shaft so said hole is coincident on a point on said cylindrical wedge cam which lies either clockwise or counterclockwise of the apogee of said cylindrical wedge cam;

a housing having a water chamber and an oil chamber, said housing rotatably receiving said hollow shaft;

a piston carriage having piston cylinders therein and further attached tos adi housing, for reciprocally supporting said bevelled end pistons, said piston carriage further having a centrally located cylindrical passage for rotatably receiving said hollow shaft, said cylindrical passage further having a plurality of outlet passages connecting said cylindrical passage to said piston cylinders.

3. A rotating spray nozzle assembly for washing planar surfaces using pressurized water comprising:

a longitudinally disposed rotatable hollow shaft having an inlet for introducing pressurized water to the interior of said shaft;

a piston carriage having a central receiving shaft cylinder coincident to the longitudinal axis, rotatably engaged with said hollow shaft, said piston carriage further having a plurality of piston cylinders uniformly angularly oriented around, and parallel to, the longitudinal axis, for slidably holding a plurality of bevelled end pistons;

a cylindrical wedge cam attached to and circumscribing said rotatable hollow shaft;

a plurality of pistons having a piston head and a bevelled end slidably mounted within said piston cylinders and in slidable frictional engagement at the bevelled end with the surface of the cylindrical wedge cam;

a hollow distribution arm radially attached to a first end of said rotatable shaft for distributing water therefrom, whereby said hollow distribution arm rotates in a laterally disposed plane;

a plurality of spray nozzles operably attached to said distribution arm for dispersing water therefrom, in a direction normal to said laterally disposed plane; and a shaft partition laterally disposed within said rotatable shaft dividing said rotatable shaft into two portions, an upstream portion and a downstream portion, each of said portions having at least one inlet hole therein.

4. A rotating spray nozzle assembly for washing planar surfaces using pressurized water comprising:

a longitudinally disposed rotatable hollow shaft having an inlet for introducing pressurized water to the interior of said shaft;

a piston carriage having a central receiving shaft cylinder coincident to the longitudinal axis, rotatably engaged with said hollow shaft, said piston carriage further having a plurality of piston cylinders uniformly angularly oriented around, and parallel to, the longitudinal axis, for slidably holding a plurality of bevelled end pistons;

a cylindrical wedge cam attached to and circumscribing said rotatable hollow shaft;

a plurality of pistons having a piston head and a bevelled end slidably mounted within said piston cylinders and in slidable frictional engagement at the bevelled end with the surface of the cylindrical wedge cam;

a hollow distribution arm radially attached to a first end of said rotatable shaft for distributing water therefrom, whereby said hollow distribution arm rotates in a laterally disposed plane;

a plurality of spray nozzles operably attached to said distribution arm for dispersing water therefrom, in a direction normal to said laterally disposed plane;

a shaft partition laterally disposed within said rotatable shaft dividing said rotatable shaft into two portions, an upstream portion and a downstream portion, each of said portions having at least one inlet hole therein; and said inlet hole of said upstream portion of said rotatable shaft is radially advanced about the longitudinal axis of the inlet hole of the downstream portion of said rotatable shaft.

5. A rotating spray nozzle assembly comprising:

a longitudinally disposed rotatable hollow shaft;

a shaft partition disposed laterally within said rotatable hollow shaft, dividing the interior of said shaft into an upstream portion and a downstream portion, said downstream shaft portion having a hole for passing water to the interior of said shaft, said upstream shaft portion having a hole for passing water to the exterior of said shaft which is disposed radially advanced about the longitudinal axis of the hole in said lower shaft portion;

a cylindrical wedge cam attached to and circumscribing said rotatable hollow shaft;

a plurality of bevelled end pistons operably attached to said cam and further being reciprocally activated by said pressurized water source;

a hollow distribution arm radially attached to the upstream end of said rotatable shaft for distributing water therefrom;

a housing having a water chamber and an oil chamber, said housing rotatably receiving said hollow shaft;

a piston carriage having piston cylinders therein and further attached tos adi housing, for reciprocally supporting said bevelled end pistons, said piston carriage further having a centrally located cylindrical passage for rotatably receiving said hollow shaft, said cylindrical passage further having a plurality of outlet passages and distribution passages connecting said cylindrical passage to each end of said piston cylinders.

* * * * *